US007066334B2

(12) United States Patent
Eeles et al.

(10) Patent No.: US 7,066,334 B2
(45) Date of Patent: Jun. 27, 2006

(54) SCREENING PANEL SECURING SYSTEM

(75) Inventors: John William Eeles, Eleebana (AU); Ronald Leslie Johnson, Charlestown (AU); Peter Martin Olsen, Toronto (AU)

(73) Assignee: Weatherford Austrailia Pty LTD (AU)

( * ) Notice: Subject to any disclaimer, the term of this patent is extended or adjusted under 35 U.S.C. 154(b) by 0 days.

(21) Appl. No.: 10/493,516

(22) PCT Filed: Oct. 29, 2002

(86) PCT No.: PCT/AU02/01463

§ 371 (c)(1),
(2), (4) Date: Sep. 20, 2004

(87) PCT Pub. No.: WO03/039770

PCT Pub. Date: May 15, 2003

(65) Prior Publication Data

US 2005/0016901 A1 Jan. 27, 2005

(30) Foreign Application Priority Data

Nov. 6, 2001 (AU) ..... PR8697

(51) Int. Cl.
*B07B 1/49* (2006.01)

(52) U.S. Cl. ..... 209/405; 209/399; 209/395; 209/403

(58) Field of Classification Search ..... 209/399, 209/395, 403, 405
See application file for complete search history.

(56) References Cited

U.S. PATENT DOCUMENTS

| | | | | |
|---|---|---|---|---|
| 5,104,521 | A * | 4/1992 | Rutherford | 209/399 |
| 6,206,200 | B1 * | 3/2001 | Gilles et al. | 209/399 |
| 6,253,926 | B1 * | 7/2001 | Woodgate | 209/399 |
| RE38,303 | E * | 11/2003 | Askew | 209/405 |

FOREIGN PATENT DOCUMENTS

| | | |
|---|---|---|
| AU | 47137/89 A | 7/1990 |
| AU | 97218/98 A | 3/1999 |
| WO | WO 02/49777 A1 | 6/2002 |

* cited by examiner

*Primary Examiner*—Kathy Matecki
*Assistant Examiner*—Terrell Matthews
(74) *Attorney, Agent, or Firm*—Greenberg Traurig, LLP

(57) ABSTRACT

A screening assembly 10 includes at least one rail 14 to be secured to a support member of a screening machine to lie parallel to, and intermediate, side members of the screening machine. At least one locating formation 18 stands proud of an operatively upper surface of each rail 14. The assembly includes a plurality of screening modules 12. Each screening module 12 has an end supported on the rail 14 so that a pair of modules 12 lie in end-to-end abutting relationship with the abutting ends, in use, overlying the rail 12 and defining a receiving formation through which the locating formation 18 protrudes to project beyond the receiving formation into a recessed region defined by the abutting ends of the pair of modules 12. A locking member 46 is associated with the receiving formation and is receivable in the recessed region for engaging its associated locating formation to lock the pair of modules with respect to each other and with respect to the rail 14. An upper surface of the locking member 46, when the locking member is received in the recessed region, lies substantially flush with upper surfaces of the modules 12 of the pair of modules.

20 Claims, 3 Drawing Sheets

SCREENING PANEL SECURING SYSTEM

FIELD OF THE INVENTION

This invention relates to screening systems. More particularly, the invention relates to the securing of screening panels to a screening machine.

More specifically, the invention relates to a screening assembly and to components for a screening assembly.

SUMMARY OF THE INVENTION

According to a first aspect of the invention, there is provided a screening assembly which includes:

at least one rail to be secured to a support member of a screening machine to lie parallel to, and intermediate, side members of the screening machine;

at least one locating formation standing proud of an operatively upper surface of said at least one rail;

a plurality of screening modules, each screening module having an end supported on said at least one rail so that a pair of modules lie in end-to-end abutting relationship with the abutting ends, in use, overlying the at least one rail and defining a receiving formation through which the at least one locating formation protrudes to project beyond the receiving formation into a recessed region defined by the abutting ends of the pair of modules; and a locking member associated with the, or each, receiving formation and receivable in said recessed region for engaging its associated locating formation to lock the pair of modules with respect to each other and with respect to the rail, in use, an upper surface of the, or each, locking member, when the locking member is received in the recessed region, lying substantially flush with upper surfaces of the modules of the pair of modules.

The assembly may include a plurality of locating formations arranged at longitudinally spaced intervals along the length of the rail, at least one locating formation being associated with each pair of screening modules. If desired, two such locating formations may be associated with each pair of modules.

Those skilled in the art will appreciate that, in general, the screening modules are substantially rectangular when viewed in plan and have their shorter sides arranged in a direction of flow of material over the screening modules. The ends of the screening modules may be the shorter sides of the screening modules which are received over their associated rails.

Further, it will be appreciated that, where each pair of modules is secured to the rail by more than one locating formation, the same number of parts of receiving formations and recessed regions may be arranged at spaced intervals along each end of each module.

Each locating formation may be in the form of a hook defining a groove within which an engaging part of the locking member is received. The engaging part of the locking member may be a tongue which extends transversely to the ends of the screening modules to engage the hook of the associated locating formation.

The recessed region, when viewed in a vertical plane, may be substantially half moon shaped. The locking member may have a complementary half moon shape with a flat upper surface to be snugly received in the recessed region with the upper surface of the locking member lying substantially flush with the upper, screening surfaces of the modules.

A floor of the recessed region may carry transverse ribs on which the locking member is received and relative to which the locking member can slide to facilitate locking insertion of the locking member into the recessed region.

It will be appreciated that, because the modules of each pair of modules abut in end-to-end relationship, each end of the screening module may define a part of the receiving formation and recessed region so that, when the two modules are placed in end-to-end abutment, the completed receiving formation and recessed region are formed.

The part of the recessed region in the end of each module may have a first, outer portion and a second, inner portion, the outer portion opening out into a side of the module and the first portion having a smaller diameter than the second portion. The locking member may be correspondingly half-spool-shaped so that, when it is inserted into the recessed region, outer, flange portions of the half-spool-shaped locking member are received in the pair of second regions of the recessed region defined by the pair of abutting modules, to lock the modules together.

Each rail may be in the form of a flat bar with the locating formations being secured to one of the longer sides of the flat bar.

An operatively lower surface of each module may be stepped at its end to overlie the rail so that, when the modules are arranged in end-to-end abutment, a channel is formed within which the rail is received.

The rail and its associated locating formations may be of metal-reinforced plastics. Similarly, the locking member may also be of a plastics material having metal reinforcing therein. The modules may also be of a plastics material suitably reinforced. Conveniently, all the plastics materials may be polyurethane materials. It is important that the hardness of the plastics material used for the locking member differs from that of the modules to inhibit binding of the locking member relative to its associated modules. Typically, the locking member may be of a harder plastics material than the modules.

According to a second aspect of the invention, there is provided a screening module for a screening assembly, the screening module including:

a body member having a pair of opposed ends;

a part of at least one receiving formation defined in at least one of the ends of the body member, the part of the receiving formation, in use, mating with a corresponding part of a receiving formation of a body member of an identical module arranged in end-to-end abutment; and a part of a recessed region associated with the, or each, receiving formation in said at least one end of the body member, the part of the recessed region similarly mating with a corresponding part of a recessed region of the body member of the identical module when arranged in end-to-end abutment, said part of the recessed region being half moon shaped in a plane of the at least one end of the body member.

Each end of the body member may be stepped at its lower edge to overlie a support member of the screening assembly.

According to a third aspect of the invention, there is provided an intermediate rail for a screening assembly, the intermediate rail including:

an elongate element to be secured to an underlying support member of a screening machine; and at least one locating formation standing proud of an operatively upper surface of said elongate element.

According to a fourth aspect of the invention, there is provided a locking member for a screening assembly, the locking member including:

a body member having an arcuate periphery, when viewed from a side of the body member, and a planar upper surface; and an engaging element carried in the body member for engaging a locating formation of the screening assembly when the body member is inserted into a recessed region defined by abutting ends of a pair of screening modules, the upper surface of the body member lying substantially flush with upper, screening surfaces of the screening modules, in use.

BRIEF DESCRIPTION OF THE DRAWINGS

The invention is now described by way of example with reference to the accompanying drawings in which.

DETAILED DESCRIPTION OF THE DRAWINGS

Figure 1:
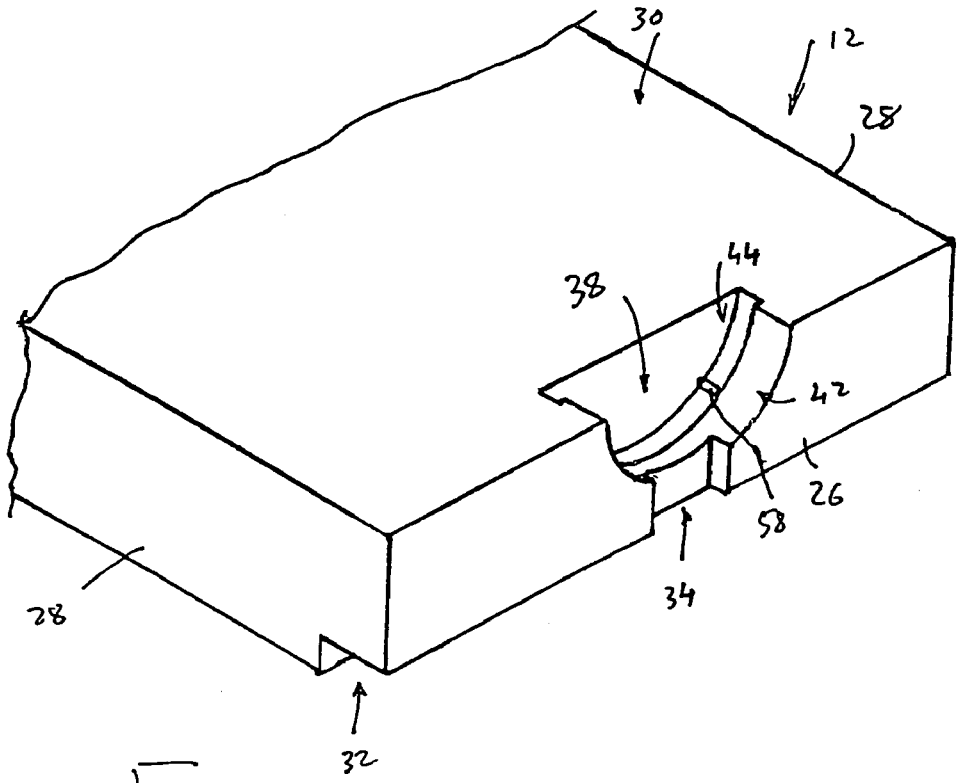
FIG. 1 shows a three-dimensional view of a part of a screening module, in accordance with an aspect of the invention, for a screening assembly, in accordance with another aspect of the invention, with screening apertures of the module omitted for the sake of clarity.
Figure 4:
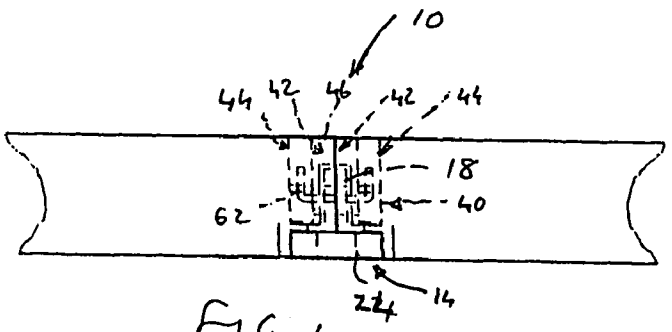
FIG. 4 shows a schematic side view of the part of the screening assembly.
Figure 3:
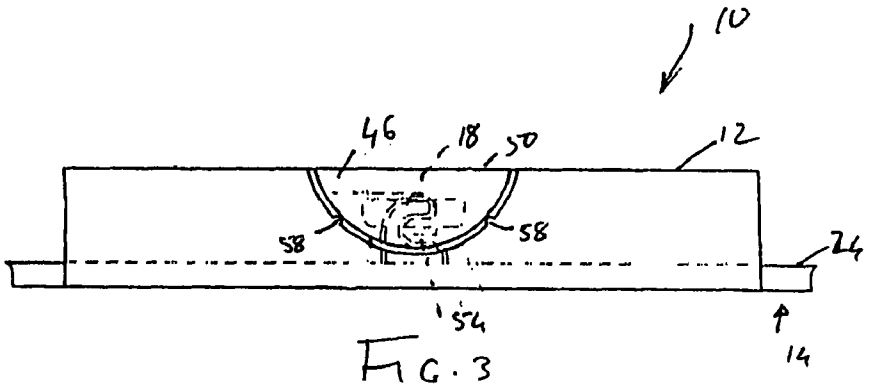
FIG. 3 shows a schematic end view of a part of the screening assembly.

In the drawings, reference numeral 10 (FIGS. 3–5) generally designates a screening assembly, in accordance with a first aspect of the invention. The screening assembly comprises a plurality of screening modules 12 in accordance with a second aspect of the invention, one of which is shown in FIG. 1 of the drawings. The screening modules are mounted on a sub-frame (not shown) of a screening machine (also not shown). The sub-frame and the screening machine are well known in the art and are not described any further.

Figure 2:
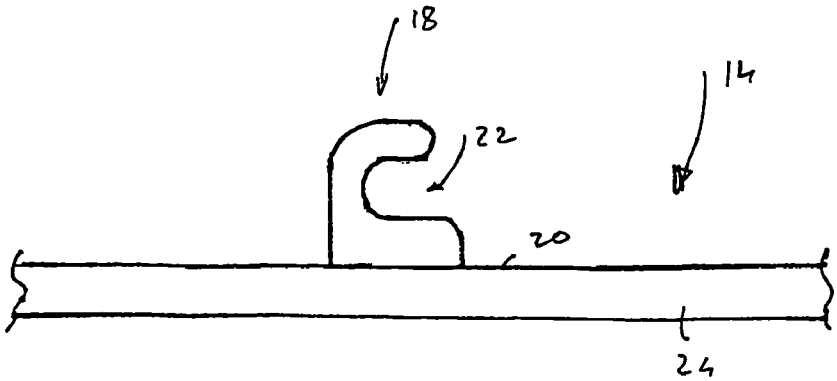
FIG. 2 shows a side view of a part of an intermediate rail, in accordance with yet a further aspect of the invention, of the screening assembly, the rail being shown on an enlarged scale in comparison with the screening module of FIG. 1.

The modules 12 are secured to the sub-frame of the machine in end-to-end abutting relationship by means of intermediate rails, in accordance with a third aspect of the invention, one of which is shown at 14 in FIG. 2 of the drawings. It is to be noted that, in FIG. 1 of the drawings, screening apertures of the screening module 12 are omitted for the sake of clarity.

In addition to pairs of modules 12 being arranged in end-to-end relationship, the screening modules 12 are also arranged in side-by-side relationship to form a screening surface over which material to be sorted and screened passes. The screening modules 12 are, in use, arranged with their shorter sides in a direction of flow, as indicated by arrow 16 in FIG. 5 of the drawings, of the material to be screened.

The intermediate rails 14 are arranged in spaced parallel relationship extending in the direction of flow 16 of the material.

Each intermediate rail 14 carries a plurality of locating formations in the form of hooks 18 thereon. There are the same number of hooks 18 as there are pairs of end-to-end abutting modules 12 in the array of screening modules forming the screening surface. However, if desired, each pair of modules 12 could have two or more longitudinally spaced (in the direction of flow 16 of the material) hooks 18.

Each hook 18 stands proud of an upper surface 20 of its associated intermediate rail 14 and has a groove 22 defined therein. The rail 14 is of a flat bar 24 and each hook 18 is mounted on the upper surface 20 of the flat bar 24. The hooks 18 are arranged along a longitudinal axis of the flat bar 24.

Referring now to FIG. 1 of the drawings, the module 12 is described in greater detail. The module 12 is substantially rectangular having a pair of shorter sides or ends 26 and a pair of longer sides 28. The sides 28 and the ends 26 bound a screening surface 30 of the module 12.

Figure 5:
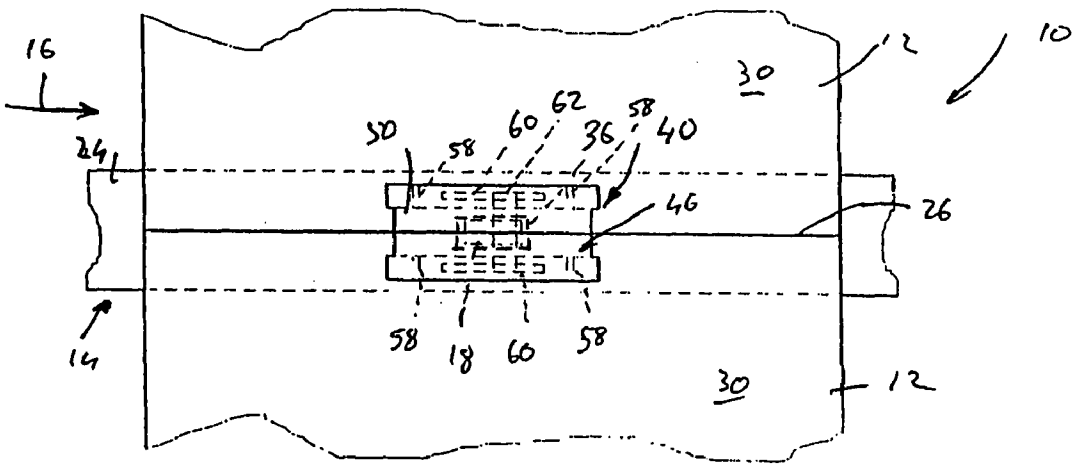
FIG. 5 shows a plan view of the part of the screening assembly.

The ends 26 of the module 12 are undercut, as illustrated at 32 so that the ends 26 of the modules 12 can overlie the flat bar 24 of the rail 14 with pairs of the modules 12 abutting as shown in FIG. 5 of the drawings. A part 34 of a receiving formation is defined in each end 26 of the module 12. When the modules 12 are aligned in abutting relationship, the part 34 of the abutting modules 12 combine to form a slot 36 through which one of the hooks 18 of the rail 14 passes.

An upper end of the part 34 opens out into a floor of a part of a recessed region 38 defined in the end 26 of the module 12. The part 38 has a first, outer portion 40 and a second, inner portion 42. Both parts 42 and 44 are arcuate or half-moon shaped with the part 42 having a smaller diameter than that of the part 44.

Once again, when the parts 38 are aligned, ie. when the modules of a pair of modules are arranged in end-to-end abutting relationship, the two mating parts 38 define a substantially half spool-shaped recess 40 in which a locking member 46, in accordance with a fourth aspect of the invention, is received.

The locking member 46 has a similarly half-moon shaped lower peripheral portion 48 and a substantially planar top surface 50. The dimensions of the arcuate, half-moon portion 48 of the locking member 46 are similar to those of the recess 40 to fit snugly in the half spool shaped recess 40. A flange portion 52 of the locking member 46 is received in each portion 44 of the part 38 in the end 26 of the module 12. This serves to lock the pairs of modules 12 together in a direction transverse to the direction of flow 16 of material over the screening modules 12.

Figure 6:
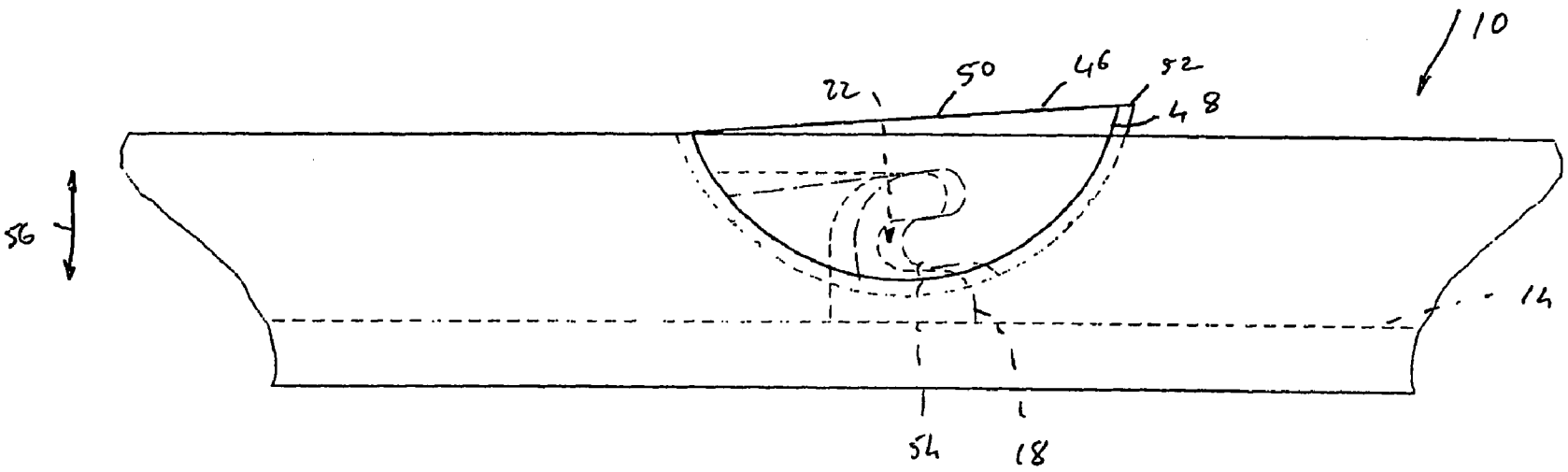
FIG. 6 shows, on an enlarged scale, a schematic end view illustrating insertion of a locking member of the screening assembly.

A centrally arranged engaging member or finger 54 (FIG. 6) is defined between the flange portions 52 of the locking member 46. When the locking member 46 is driven home into the recess 40, the finger 54 is received in the groove 22 of the hook 18 to lock the pairs of modules 12 against movement in the direction of arrows 56 (FIG. 6).

Also, when the locking member 46 is inserted fully into the recess 40, its upper surface 50 lies substantially flush with the upper surfaces 30 of the screening modules 12 so as not to impede flow of material over the upper surfaces 30 of the screening modules 12.

To facilitate insertion of the locking member 46 into the recess 40, transverse ribs 58 are defined in a floor region of each portion 44 of the part 38 in each end 26 of the module 12. These ribs 58 act as "rollers" for the flange portions 52 of the locking member 46. They also act as pressure points to keep the locking member 46 in a locking condition in the recess 40.

It is to be noted that the bar 24 of the rail 14 is coated with a plastics material, more particularly, polyurethane Similarly, the hook 18 is formed from a plastics-coated metal element.

The locking member has reinforcing elements 60 therein. Similarly, the finger 54 has a reinforcing bar 62 arranged therein.

The locking member 46 is also formed of a plastics material, more particularly, polyurethane as is each module 12. The polyurethane from which the locking member 46 is made is selected to be harder than the polyurethane from which the modules 12 is made to inhibit binding of the locking member 46 in the recess 40. For example, the polyurethane from which the module 12 is made may be selected to have a Shore Hardness of 85–93A whereas the polyurethane from which the locking member is made may have a Shore Hardness of 95A or a Shore D-scale Hardness of 60–65.

It is an advantage of the invention that an assembly 10 is provided where the modules 12 are secured to an intermediate rail 14 with a positive locking action by the locking member 46. In addition, the locking member 46 lies flush with upper surfaces 30 of the modules 12 so that a smooth screening surface is provided by the array of screening modules. Further, the locking member 46 can be inserted and removed without the need for any special tools. It will be appreciated that all that is required to remove the locking member 46 from the recess 40 is a screwdriver.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A screening assembly which includes:

at least one rail to be secured to a support member of a screening machine to lie parallel to, and intermediate, side members of the screening machine;

at least one locating formation standing proud of an operatively upper surface of said at least one rail;

a plurality of screening modules, each screening module having an end supported on said at least one rail so that a pair of modules lie in end-to-end abutting relationship with the abutting ends, in use, overlying the at least one rail and defining a receiving formation associated with the, or each, locating formation and through which the associated locating formation protrudes to project beyond the receiving formation into a recessed region defined by the abutting ends of the pair of modules, the recessed region, when viewed in a plane normal to a screening surface of the module, being substantially half-moon shaped; and a locking member associated with the, or each, receiving formation and receivable in said recessed region for engaging its associated locating formation to lock the pair of modules with respect to each other and with respect to the rail, in use, an upper surface of the, or each, locking member, when the locking member is received in the recessed region, lying substantially flush with upper surfaces of the pair of modules.

2. The assembly of claim 1 which includes a plurality of locating formations arranged at longitudinally spaced intervals along the length of the rail, at least one locating formation being associated with each pair of screening modules.

3. The assembly of claim 1 in which said ends of the screening modules are shorter sides of the screening modules which are received over their associated rails.

4. The assembly of claim 1 in which each locating formation is in the form of a hook defining a groove within which an engaging part of the locking member is received.

5. The assembly of claim 4 in which the engaging part of the locking member is a tongue which extends transversely to the ends of the screening modules to engage the hook of the associated locating formation.

6. The assembly of claim 1 in which the locking member has a complementary half-moon shape with a flat upper surface to be snugly received in the recessed region with the upper surface of the locking member lying substantially flush with the upper, screening surfaces of the modules.

7. The assembly of claim 6 in which a floor of the recessed region carries transverse ribs on which the locking member is received and relative to which the locking member can slide to facilitate locking insertion of the locking member into the recessed region.

8. The assembly of claim 1 in which each end of the screening module defines a part of the receiving formation and recessed region so that, when the two modules are placed in end-to-end abutment the completed receiving formation and recessed region are formed.

9. The assembly of claim 8 in which the part of the recessed region in the end of each module has a first, outer portion and a second, inner portion, the outer portion opening out into a side of the module and the first portion having a smaller diameter than the second portion.

10. The assembly of claim 9 in which the locking member is correspondingly half-spool-shaped so that, when it is inserted into the recessed region, outer, flange portions of the half-spool-shaped locking member are received in the pair of spaced second portions of the recessed region defined by the pair of abutting modules, to lock the modules together.

11. The assembly of claim 1 in which each rail is in the form of a flat bar with the locating formations being secured to one of the longer sides of the flat bar.

12. The assembly of claim 1 in which an operatively lower surface of each module is stepped at its end to overlie the rail so that, when the modules are arranged in end-to-end abutment, a channel is formed within which the rail is received.

13. The assembly of claim 1 in which the rail and its associated locating formations are of metal-reinforced plastics.

14. The assembly of claim 1 in which the locking member is of a plastics material having metal reinforcing therein.

15. The assembly of claim 14 in which the modules are of a plastics material suitably reinforced.

16. The assembly of claim 15 in which the hardness of the plastics material used for the locking member differs from that of the modules to inhibit binding of the locking member relative to its associated modules.

17. A screening module for a screening assembly, the screening module including:

a body member having a pair of opposed ends;

a part of at least one receiving formation defined in at least one of the ends of the body member, the part of the receiving formation, in use, mating with a corresponding part of a receiving formation of a body member of an identical module arranged in end-to-end abutment; and a part of a recessed region associated with the, or each, receiving formation in said at least one end of the body member, the part of the recessed region similarly mating with a corresponding part of a recessed region of the body member of the identical module when arranged in end-to-end abutment, said part of the recessed region being half-moon shaped in a plane of the at least one end of the body member which is perpendicular to a screening surface of the module.

18. The module of claim 17 in which each end of the body member is stepped at its lower edge to overlie a support member of the screening assembly.

19. An intermediate rail for a screening assembly, the intermediate rail including:

an elongate element to be secured to an underlying support member of a screening machine; and at least one locating formation standing proud of an operatively upper surface of said elongate element the locating formation comprising a planar body member standing proud of the elongate element and lying in a plane parallel to a longitudinal axis of the elongate element, the locating formation further defining an engaging element to be engaged by an engaging part of a locking member used to secure a screening module of the screening assembly to the elongate element which also lies in the plane parallel to and oriented with the longitudinal axis.

20. A locking member for a screening assembly, the locking member including:

a body member having a planar upper surface and a substantially half moon shaped periphery when viewed from a side of the body member in a plane at right angles to the upper surface; and an engaging element carried in the body member for engaging a locating formation of the screening assembly when the body member is inserted into a recessed region defined by abutting ends of a pair of screening modules, the upper surface of the body member lying substantially flush with upper, screening surfaces of the screening modules, in use.

* * * * *